US008931376B2

(12) United States Patent
Humphrey

(10) Patent No.: US 8,931,376 B2
(45) Date of Patent: Jan. 13, 2015

(54) APPARATUS FOR EXTENDING THE EFFECTIVE LENGTH OF TOOL SHANKS AND METHOD FOR MANUFACTURING

(76) Inventor: Jackie Dudley Humphrey, Riverview, FL (US)

( * ) Notice: Subject to any disclaimer, the term of this patent is extended or adjusted under 35 U.S.C. 154(b) by 0 days.

(21) Appl. No.: 13/369,625

(22) Filed: Feb. 9, 2012

(65) Prior Publication Data

US 2013/0233134 A1 Sep. 12, 2013

(51) Int. Cl.
*B25G 1/04* (2006.01)
*B25G 1/00* (2006.01)

(52) U.S. Cl.
CPC ..... *B25G 1/005* (2013.01); *B25G 1/043* (2013.01)
USPC ..... 81/177.2

(58) Field of Classification Search
USPC ..... 81/52, 177.1, 177.2, 180.1, 184; 16/429; D8/27
See application file for complete search history.

(56) References Cited

U.S. PATENT DOCUMENTS

| | | | | | |
|---|---|---|---|---|---|
| 1,209,012 | A * | 12/1916 | O'Brien | 81/176.3 |
| 2,490,739 | A * | 12/1949 | Nesbitt | 81/177.2 |
| 4,644,600 | A * | 2/1987 | Fugate | 7/166 |
| 4,960,014 | A * | 10/1990 | Kelley | 81/177.2 |
| D328,017 | S * | 7/1992 | Boeke et al. | D8/21 |
| 5,528,964 | A * | 6/1996 | Smith, Jr. | 81/180.1 |
| D394,992 | S * | 6/1998 | Landin | D8/21 |
| 5,832,794 | A * | 11/1998 | Fowler | 81/177.2 |
| D421,379 | S * | 3/2000 | Sanford | D8/107 |
| 6,308,596 | B1 * | 10/2001 | Williams | 81/177.2 |
| D476,203 | S * | 6/2003 | Mahan | D8/21 |
| 7,186,048 | B2 * | 3/2007 | Robins | 403/109.3 |
| 7,188,553 | B1 * | 3/2007 | Pryor | 81/177.2 |
| 7,272,996 | B2 * | 9/2007 | Pontieri | 81/176.15 |
| D598,257 | S * | 8/2009 | Darby et al. | D8/27 |
| D630,481 | S * | 1/2011 | Hutt et al. | D8/27 |
| 2004/0025649 | A1 * | 2/2004 | Rugee | 81/177.2 |
| 2005/0183550 | A1 * | 8/2005 | Day | 81/177.2 |
| 2007/0240545 | A1 * | 10/2007 | Lin | 81/177.2 |

* cited by examiner

*Primary Examiner* — David B Thomas

(57) ABSTRACT

An apparatus for providing an increased moment of applied force to a tool. An elongated member extends the effective length of tool shanks. The elongated member has tool support to fit a range of tools, such as wrenches, to the elongated member which increases the distance from the fastener to the point of applied force, thereby increasing the moment of the applied force.

16 Claims, 10 Drawing Sheets

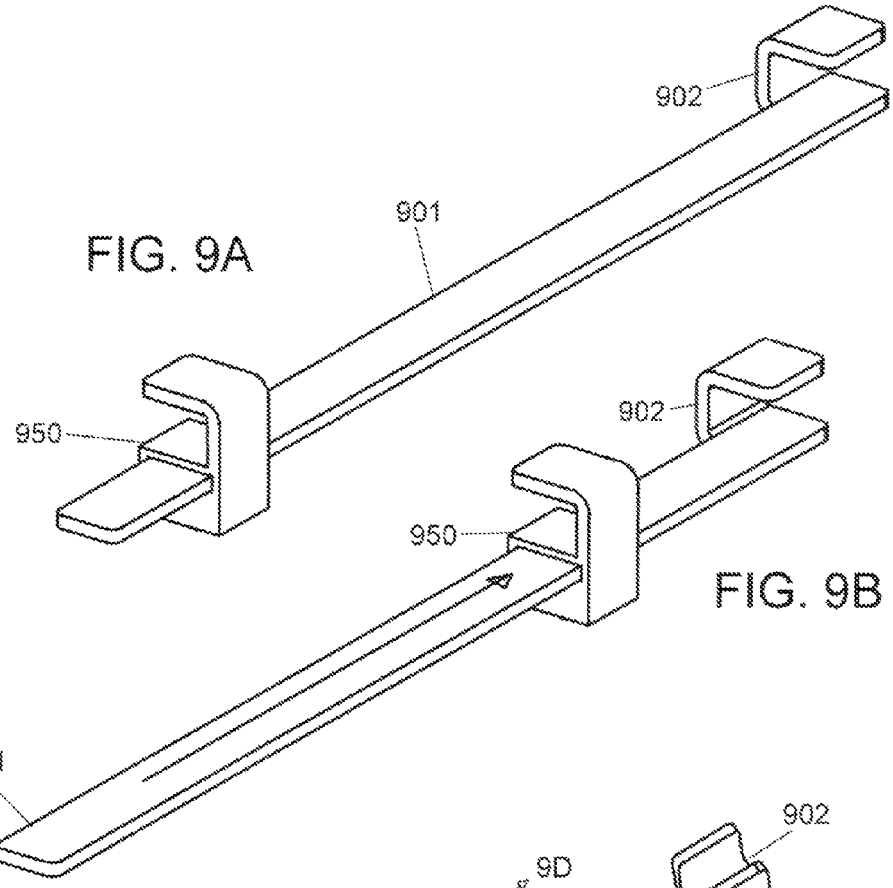
FIG. 9A
FIG. 9B
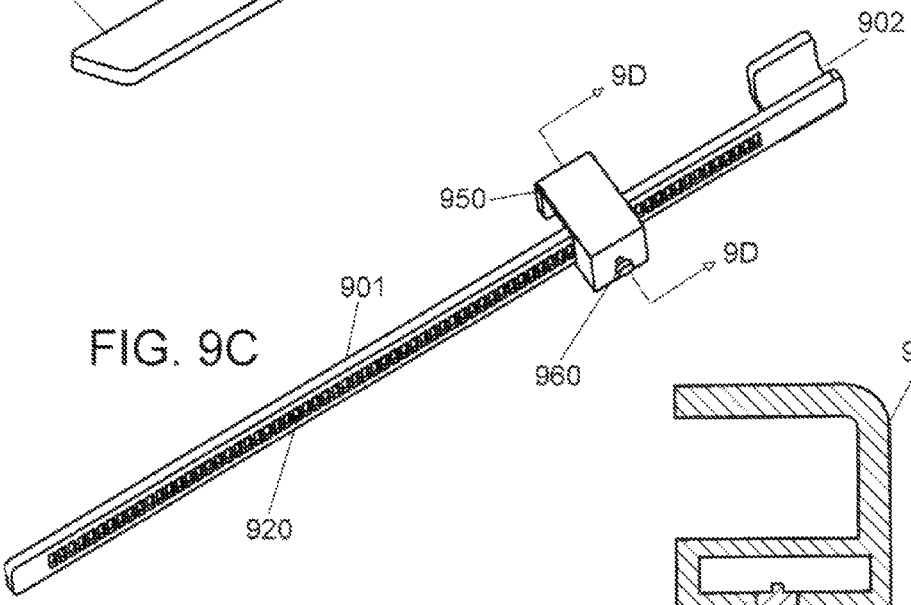
FIG. 9C
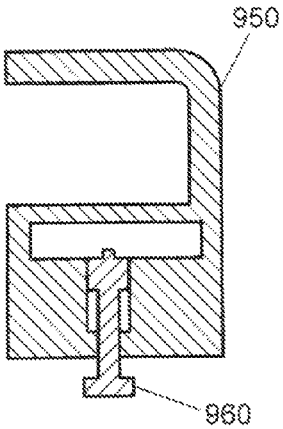
FIG. 9D

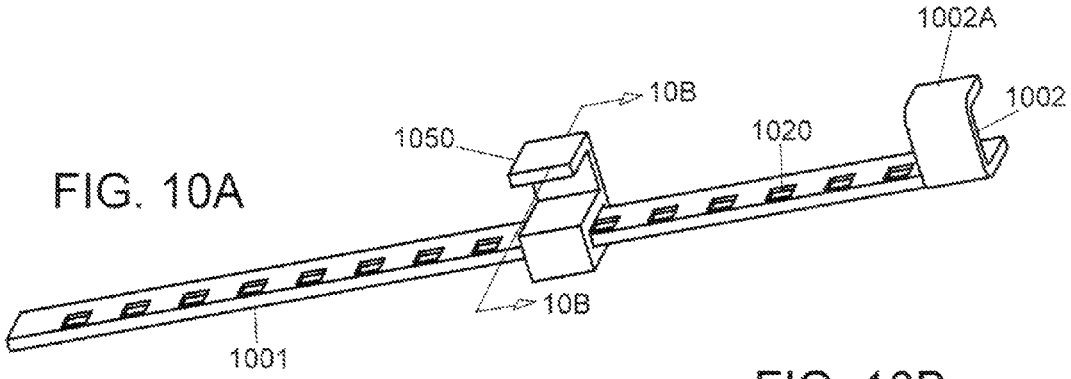
FIG. 10A
FIG. 10B
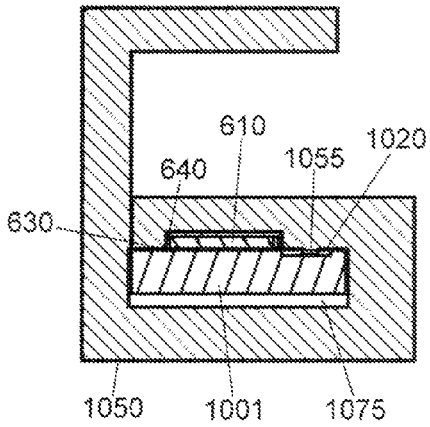
FIG. 11B
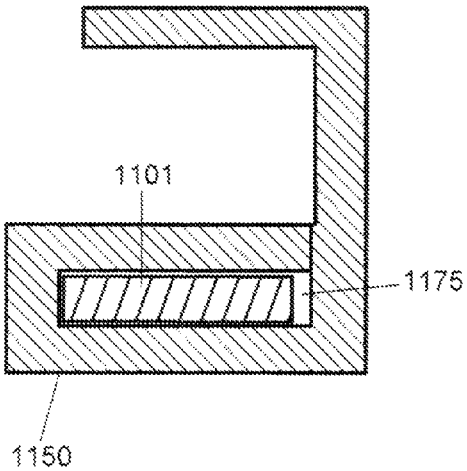
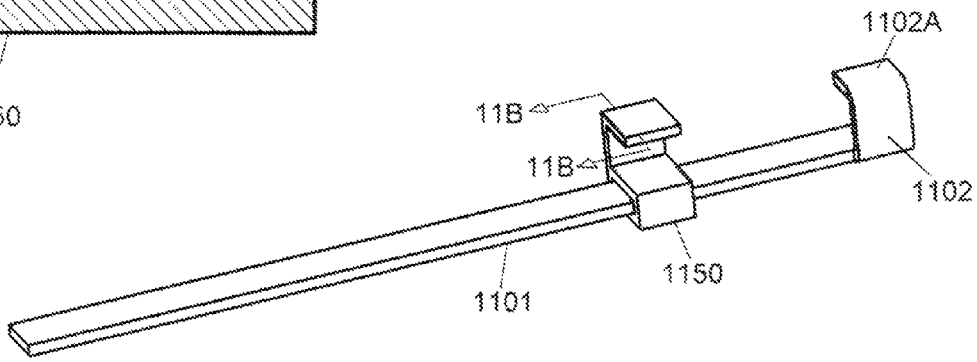
FIG. 11A

APPARATUS FOR EXTENDING THE EFFECTIVE LENGTH OF TOOL SHANKS AND METHOD FOR MANUFACTURING

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

The present invention pertains generally to tools, tool attachments and manufacture of same, and more particularly to apparatus for extending effective lengths of wrench shanks for increasing moments of applied force, and process for manufacturing of same. In the mechanical arts of repair and construction, a routineer may be expected to perform his services speedily and accurately in order to satisfy possibly waiting customers and to maintain a successful enterprise, profession or occupation with cost-effectiveness. As a result, mechanics may depend heavily on tools that provide dependability and ease of use. Often, such quality tools may represent a significant investment for the user or his employer.

A typical example of a predicament that may cause a setback, or at least may impede the progress of service workflow, is an encounter with a fastener that may not loosen even when heavy force is applied to a wrench which is properly sized to fit the fastener. Numerous factors such as corrosion, dirt and others may make it difficult to apply sufficient force to create a moment of the force necessary to move or rotate the fastener. Increased moments of force may also be needed for tightening fasteners.

The moment of a force, as used herein, is a measure of its tendency to turn, rotate, bend or break a body about its moment axis. For example, the moment axis of a bolt may be the central axis of the bolt, and the moment of an applied force may be the tendency to turn (loosen or tighten) the bolt. The applied force may be the force a mechanic applies to a wrench. The moment of the applied force is the product of the force and the distance from the moment axis. The distance from the moment axis may be the length of the wrench. As is well known, a longer tool may provide a greater tendency to rotate a bolt. A well known example of a longer tool is a breaker bar for use with sockets. A socket with a breaker bar may loosen a bolt which may resist loosening when using a wrench such as an open-end or box-end wrench.

There are circumstances, however, where use of such a wrench may be needed, and mechanics have traditionally improvised various extensions to such wrenches to provide greater moments of applied forces by increasing the distance between the stubborn bolt and the point of force application.

A traditional solution which may be used by mechanics to overcome this type of predicament is called double-wrenching. As can be seen in FIG. 1, two wrenches, 101 and 102 are locked together in order to provide an effectively longer handle. The stubborn fastener 150 is typically inserted into the box end of wrench 101, and the mechanic applies force to the open end of wrench 102 in the direction as shown by the arrow. This technique may have some convenience because multiple wrenches may be generally close at hand and because the increased rotational moment due to the effectively longer handle for the same force applied may often result in successfully loosening the fastener.

Double-wrenching, although convenient at times, has several drawbacks. One problem is tool damage. High quality wrenches may be made from tool-steel which is very hard and durable. However, when such wrenches are locked together and heavy force is applied the hard steel of one may tend to dig into the hard steel of the other and vice versa, thereby generating nicks and pits on the precision-ground working ends. Manufacturers of quality tools may guarantee them for life, but the guarantee may become void if double-wrenching nicks are found.

Another type of tool damage which may be caused by double-wrenching is tool shaft bending. Tool shafts for wrenches are typically oblong in cross-section and are designed so that the long dimension of the oblong cross-section transfers the applied force to the work because each working end of the wrench is aligned with the long dimension of the oblong cross-section shaft. This makes wrenches very strong when force is applied to it in a correct manner. The short dimension of the oblong cross-section transfers little force because it is aligned perpendicularly to the working ends. So, the long dimension, or the thick part of the wrench shaft may easily transfer large forces reliably, while the short dimension, or the thinner part of the wrench shaft reduces the weight of the wrench and may make it more comfortable to use. However, when double-wrenching, the locked working ends result in the wrench shafts aligning in a perpendicular direction with respect their cross-sections. This means that the shaft of one wrench may be subjected to a force load that exceeds its design limits and may bend or break.

As stated earlier, quality tools may be expensive. Damaging or ruining a pricey tool for a momentary convenience may not be cost-effective.

Another drawback to using double-wrenching is that it may cause physical harm to the mechanic. As can be seen at FIG. 1, the locking of the two wrenches 101 and 102 is at best tenuous. The application of force may need to be carefully directed to maintain the locking and simultaneously loosen the bolt. At times, during application of force, the two wrenches may become unlocked causing the mechanic to forcefully ram his hand against part of the machinery. Painful injury to the mechanic often accompanies this scenario.

FIG. 2 illustrates another prior art method for extending the effective length of a wrench 101. A mechanic may search the work area for a pipe 201 that may fit over the wrench 101. If such a pipe 201 is found and the pipe 201 is strong enough to transfer the applied force, then it is likely that the fastener 150 may loosen with applied force to the pipe 201 in the direction indicated by the arrow because of the longer effective wrench length. However, it is likely that many different diameter pipes may be needed to properly fit various sizes of wrenches. A further drawback is that a wrench may need to be manually held in place in the pipe until force is applied, otherwise, the wrench may slip inside the pipe. Also, a hollow pipe may be subject to bending when force is applied because it may lack the structural geometry required for transferring an applied force.

Therefore, there is a need in the art for an apparatus which may provide for an increased distance from a moment axis to a point where force is applied so that the applied force may result in an increased moment of the force at the moment axis.

BRIEF SUMMARY OF THE INVENTION

Briefly, the present invention provides apparatus for increasing moments of forces when users apply such forces to tools. The increased moments of applied forces, according to the present invention, are generated by extending effective lengths of tool shanks.

In one implementation, the apparatus comprises an elongated member having at least a first tool support and a second tool support. The first tool support being attached to a side of the elongated member at a first position, the first position being near an end of the elongated member. The second tool support being attached to an opposite side of the elongated member at a second position, the second position being displaced from said first position along a linear length of said elongated member. In this manner, a range of tools may fit workably between the two tool supports.

In one implementation, a top portion of at least one of the first and second tool supports comprises an angled portion. The angled portion, along with the tool support and a portion of a top surface of the elongated member forms a tool seat such that a tool is prevented from rotating out from the tool support when force is applied.

In one implementation, an underside of the angled portion of at least one of the first and second tool supports has attached thereto a resilient frictional material in order to prevent tool slippage.

In one implementation, at least one of the first and second tool supports includes a spring material for clutching a tool for securing a tool.

In one implementation, the elongated member includes hook and loop material disposed between the first and second tool supports for securely holding a tool.

In one implementation, at least a portion of the elongated member is covered by resilient material, thereby forming a handle, thereby improving user comfort.

In one implementation, at least a portion of the elongated bar comprises an anvil permitting a user to apply an impact force without damaging the elongated bar.

In one implementation, at least one magnet is provided for holding a tool.

In another aspect, the apparatus comprises an elongated member having at least a first tool support and a second tool support, with the first tool support being attached to a side of the elongated member at a first position, the first position being near an end of the elongated member, and the second tool support being movable along at least a part of a linear length of the elongated member. In this manner, the second tool support is displaceable to positions such that a range of tools fit workably between the two tool supports.

In one implementation, a top portion of at least one of the first and second tool supports comprises an angled portion. The angled portion, the tool support and a portion of a top surface of the elongated member forms a tool seat such that a tool is prevented from rotating out from the tool support when force is applied.

In one implementation, an underside of the angled portion of at least one of the first and second tool supports has attached thereto resilient frictional material.

In one implementation, the tool seat includes spring material for clutching a tool.

In one implementation, at least one of the first and second tool supports includes magnetic material.

In one implementation, the elongated member includes hook and loop material disposed between the first and second tool supports.

In one implementation, at least a portion of the elongated member is covered by resilient material, thereby forming a handle.

In one implementation, at least a portion of the elongated member comprises an anvil.

In one implementation, the elongated member includes at least one magnet for holding a tool.

In another aspect, a process for making an apparatus for increasing a moment of force is provided. The process comprises forming a shape including an elongated member, the elongated member having a first lateral extension from a side of the elongated member and positioned substantially at an end of the elongated member, and a second lateral extension from an opposite side of the elongated member and displaced from said first lateral extension along a linear length of the elongated member, and, bending said first and second lateral extension portions, thereby forming a first and second tool support.

In one implementation, further comprising forming at least one tool seat by bending a portion of at least one of the first and second tool supports inwardly towards the elongated member.

In another aspect, a process for making an apparatus for increasing a moment of force, is provided. The process comprises forming a shape including an elongated member, the elongated member having a lateral extension from a side of the elongated member and positioned substantially at an end of the elongated member, and, bending said lateral extension, thereby forming a tool support.

Other benefits and advantages will become apparent to one having ordinary skill in the art from the following detailed description along with corresponding drawings, in which:

BRIEF DESCRIPTION OF THE SEVERAL VIEWS OF THE DRAWINGS

FIG. 9A is an illustration of an exemplary embodiment with a movable tool support.

FIG. 9B is an illustration of the exemplary embodiment of FIG. 9A with the movable tool support moved to a different position.

FIG. 9C is an illustration of the exemplary embodiment of FIG. 9A showing the underside of FIG. 9A.

FIG. 9D is an illustration of cross-section of an exemplary movable tool support of FIG. 9A.

FIG. 10A is an illustration of another exemplary embodiment with a movable tool support.

FIG. 10B is an illustration of a cross-section of an exemplary movable tool support of FIG. 10A.

FIG. 11A is an illustration of yet another exemplary embodiment with a movable tool support.

FIG. 11B is an illustration of a cross-section of an exemplary movable tool support of FIG. 11A.

DETAILED DESCRIPTION OF THE INVENTION

Figure 1:
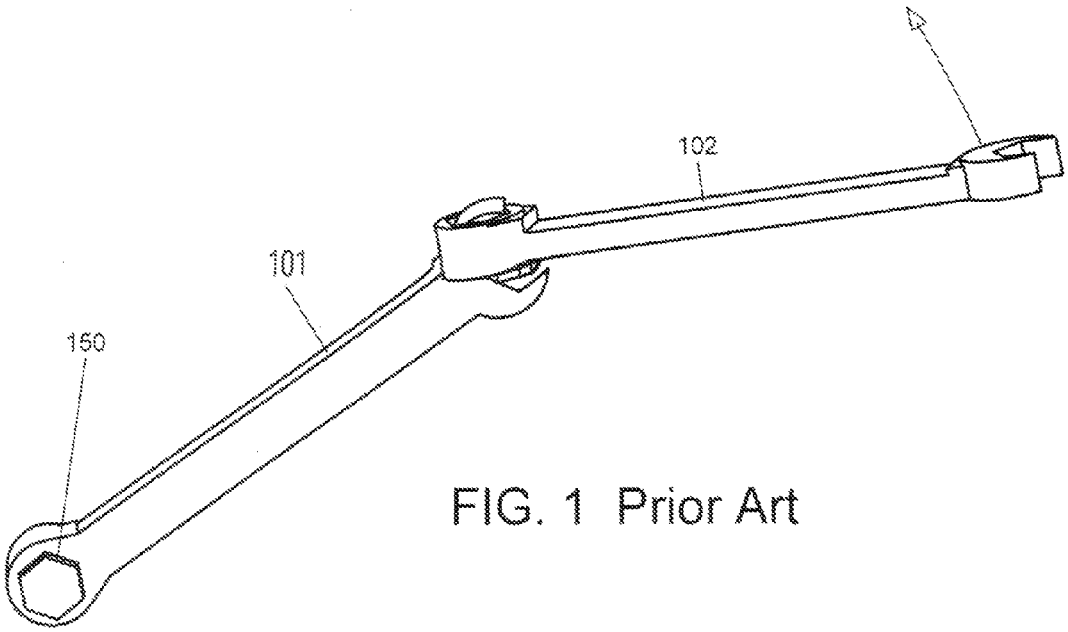
FIG. 1 Prior Art
FIG. 1 is an illustration of a prior-art technique, called double-wrenching, for extending the effective length of a tool.
Figure 2:
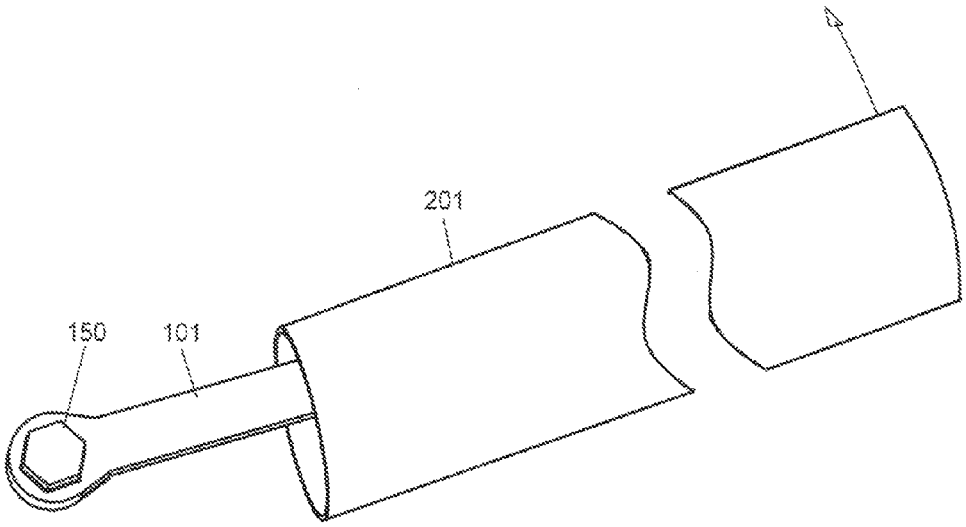
FIG. 2 Prior Art
FIG. 2 is an illustration of another prior-art for extending the effective length of a tool.
Figure 3:
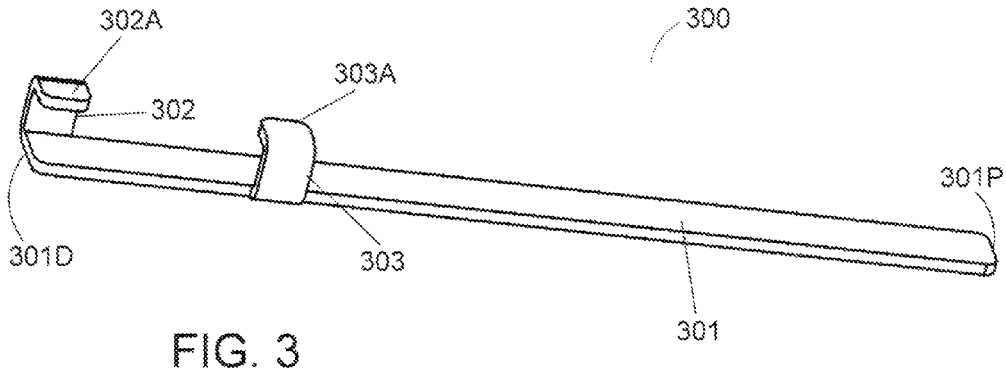
FIG. 3 is an illustration of an exemplary embodiment according to the present invention.

FIG. 3 shows a first exemplary embodiment of the present invention 300 with an elongated member 301 a first tool support 302 and a second tool support 303. In this embodiment the tool supports may be fixed to the elongated bar. The manner of fixing may include welding, bonding, by mechanical attachments such as rivets, screws or other fasteners, or by pressing the tool supports onto the elongated bar or by any other means such that the tool supports might be substantially fixed to the elongated member. The elongated bar and the tool supports may preferably be constructed from tool steel but may be made from any other material or composite that may transfer force applied near the proximal end 301P and may provide a high increased moment of force at its distal end 301D.

Figure 4:
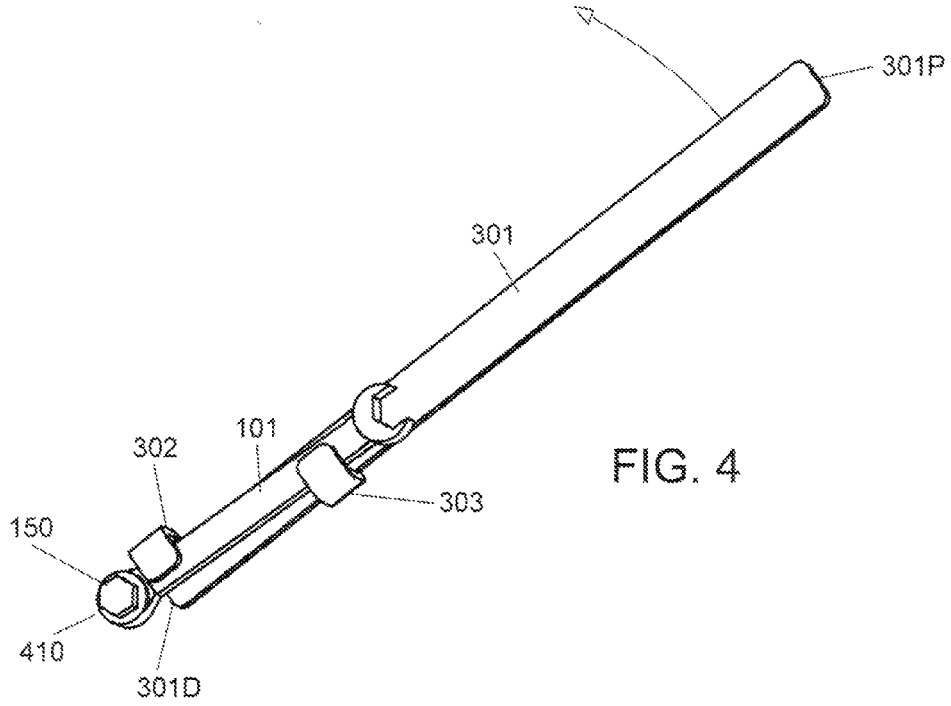
FIG. 4 is an illustration of the exemplary embodiment of FIG. 3 holding a tool.

FIG. 4 illustrates the embodiment of FIG. 3 as it may appear when holding a tool 101. In this example the tool 101 is a combination wrench with box end 410 attached to the head of a bolt 150. Force may be applied to the proximal end 301P of the elongated member 301 in the direction shown by the arrow. Tool supports 302 and 303 securely grip the tool 101 and transfer an increased moment of the applied force to the bolt 150.

The arrangement of the opposing and displaced tool supports 302 and 303 provide for easy tool insertion for tools having a range of sizes and for secure tool holding while large required forces are applied.

The orientation of the elongated member 301 and tool supports 302 and 303, as shown in FIG. 4 may be effective for rotation in the counter-clockwise direction. To change the orientation for a clockwise rotation, for example to tighten a bolt 150, the elongated member 301 may be turned upside-down, thereby aligning the tool supports 302 and 303 for transferring a moment of an applied force to a wrench 101 in a clockwise rotation (not shown).

Figure 5:
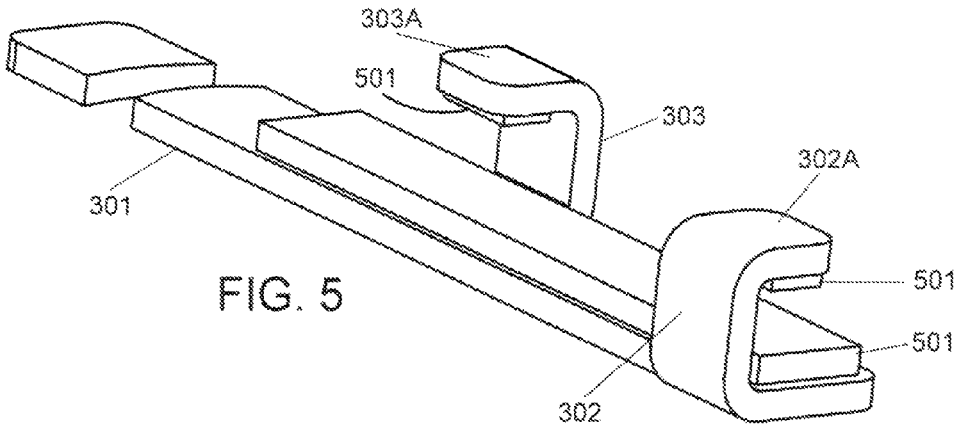
FIG. 5 is an illustration of an exemplary embodiment with frictional material.

FIG. 5 shows an exemplary embodiment in which tool supports 302 and 303 may have an angled part 302A and 303A for effectively providing a fence to keep a tool from slipping away from tool supports 302 and 303. The underside of angled parts 302A and 303A may have attached thereto resilient frictional material 501 for holding a tool securely within the tool supports. A tool may be pushed into the two opposing seats, each seat formed by its respective fence (angled part), tool support and portion of the elongated member and held in place by the resilient frictional material 501.

The resilient frictional material 501 may be natural or synthetic. For example, it may comprise rubber, neoprene, polyethylene, foam, plastic or any other material or combination of materials such that sustained pressure may be provided against a tool and resist a tendency of a tool to slip out of a tool seat.

The resilient frictional material 501 may be attached to the elongated member 301 at a location where a tool may be in contact with the elongated member.

In exemplary embodiments of FIG. 5 the resilient frictional material 501 may be attached to a surface with adhesive, with mechanical fasteners, or with any means appropriate for use with the composition of the resilient frictional material and the type of surface the material that it may be attached to.

Figure 6A:
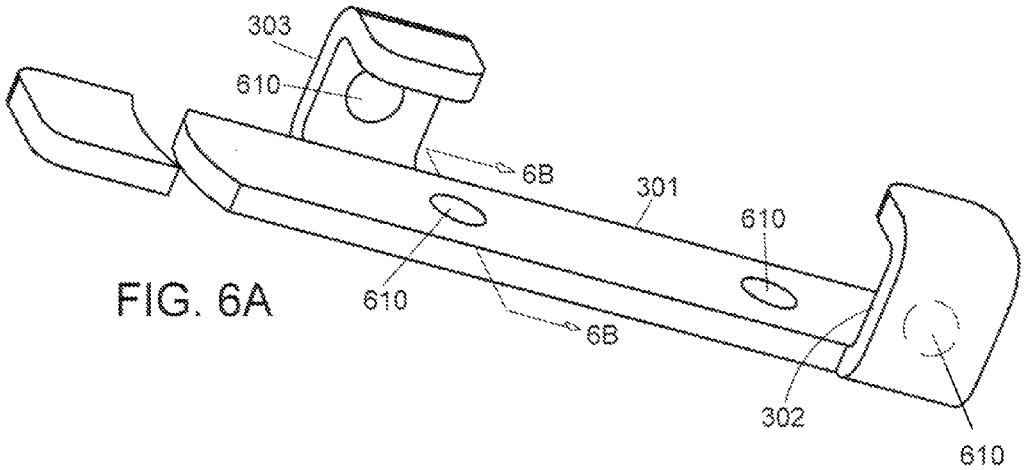
FIG. 6A is an illustration of an exemplary embodiment with magnetic material.

FIG. 6A illustrates an embodiment with tool supports 302 and 303 including magnetic material 610 for holding a tool in the tool seats. Since tools may be made from relatively heavy materials, such as tool steel, magnetic material for holding such tools may be characterized by possessing a relatively strong magnetic field and be small in size so that only relatively small modifications may be needed for attaching the magnetic material, and sufficient holding strength may be attained to prevent tools from slipping out of the tool seats. The magnetic material 610 may preferable comprise Neodimium Iron Boron (NIB), also known as rare earth magnets, because of its strong magnetic field for a relatively small size. Although, other types of magnets may be used.

Figure 6B:
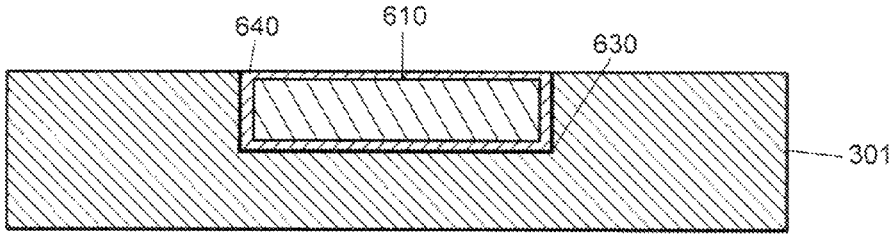
FIG. 6B is an illustration of a cross-section of a part of FIG. 6A.

Preferably, the magnets 610 may be embedded into the tool supports 302 and 303 and/or the elongated member 301 near the tool supports 302 and 303. Referring to cross sectional FIG. 6B, mounting a magnet 610 may be accomplished by boring a flat bottom hole 630 as shown in the cross-section, having a diameter sufficiently sized to accept the magnet 610, and having a depth such that the magnet 610 may be bonded inside the hole 630 with the exposed surface of the magnet 610 being substantially flush with the surface of the tool support and/or the elongated member. It is further contemplated to provide a thin protective or cushioning covering 640 for the magnetic material 610 for dampening stress, strain and impact shock that the apparatus of the present invention may be subjected to during use, for protecting the magnetic material 610 from damage.

Figure 7A:
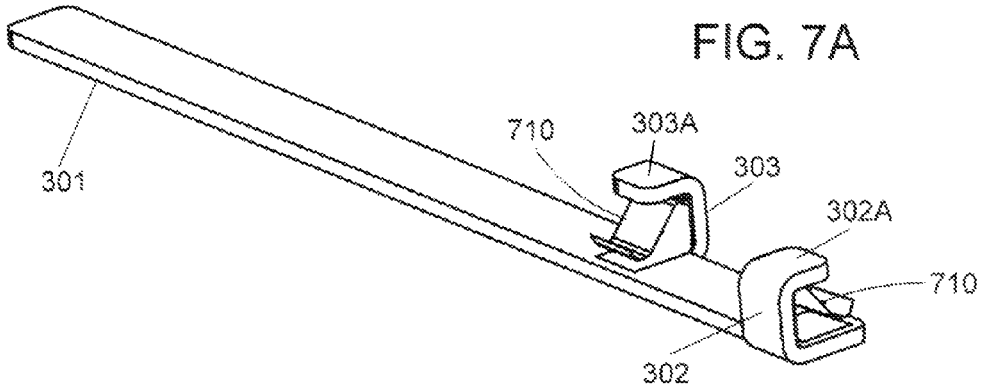
FIG. 7A is an illustration of an exemplary embodiment with spring material.
Figure 7B:
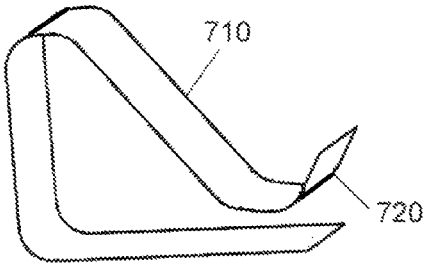
FIG. 7B is an illustration of an exemplary spring clip of FIG. 7A.

FIG. 7A shows a spring clip 710 for securing a tool to the tool seats. The spring clip 710 may be formed with a lip 720 in FIG. 7B which illustrates an end view of one tool support, so that the spring clip 710 may flex upward allowing easy insertion of a tool. The spring clip 710 may exert pressure on a tool keeping is secure within the tool seat. The spring clip 710 may preferably be made from spring steel, however, other materials characterized by a sufficient spring force to hold a tool may be used. The spring clip 710 may be fastened to the tool support by welding, or by a mechanical fastener (not shown), or simply by being pressed into the tool seat.

Figure 8:
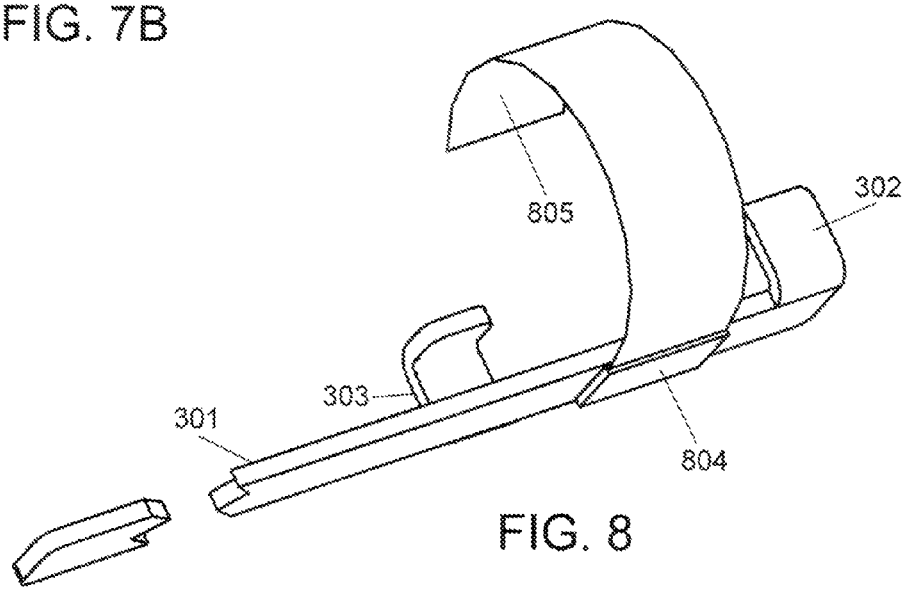
FIG. 8 is an illustration of an exemplary embodiment with hook and loop material.

FIG. 8 shows yet another way for securing a tool to the tool seats. A hook material 804 may be attached to the underside of the elongated member 301 between the tool supports 302 and 303. A loop material 805 may extend from an edge of the hook material 804 such that it may wrap over a tool and then be attached to the hook material 804 on the underside of the elongated member with sufficient tightness to hold a tool securely in the tool seats.

FIG. 9A shows an embodiment with a movable tool support 950. The movable tool support may be moved along the elongated member 901 to vary the distance between a fixed tool support 902 and the movable tool support 950 so that a variety of wrenches may be secured in the tool supports 902 and 950. FIG. 9B illustrates this embodiment with tool support 950 moved to a different position as indicated by the arrow. The movable tool support 950 may comprise a spring-loaded pin 960, as shown in FIG. 9C and in a cross-sectional view at FIG. 9D, for fitting into grooves 920, as shown in the bottom view of this embodiment at FIG. 9C, on the elongated member 901. Positioning the movable tool support 950 may be accomplished by pulling the pin 960 out partway to clear the grooves 920 on the elongated member 901 and then sliding it linearly forward or backward along the length of the elongated member 901 to a desired position, and then releasing the pin 960 and allowing a spring (not shown) to engage the pin 960 into a groove 920 on the elongated member 901, thereby securing the movable tool support 950 at a desired position along the elongated member 901. Displacing the tool support 950 from the fixed tool support 902 with varying distances therebetween may provide for a greater range of tools for fitting into the tool supports 950 and 902.

FIG. 10A shows another movable tool support 1050 which may use a magnet 610 for securing the tool support 1050 at a desired location along elongated member 1001. Tool support 1050 may have a channel 1070, as shown in the cross-sectional view at FIG. 10B, which is taller than the thickness of the elongated member 1001 so that the tool support 1050 may be positioned by lifting it off the surface of the elongated member 1001 and sliding it linearly along the length of the elongated member 1001 to a desired position, and then releasing the tool support 1050 and allowing the magnet 610 to pull it towards the upper surface of the elongated member 1001. The channel of the tool support 1050 may include a fixed pin 1055 or other detent that may seat into grooves 1020 on the top surface of the elongated member 1001 which would provide for secure positioning of the tool support 1050.

FIG. 11A illustrates another exemplary embodiment such that a movable tool support 1150 may have a channel 1175, as shown in the cross-sectional view at FIG. 11B, which is wider than the width of elongated member 1101 so that the tool support 1150 may rotate slightly with respect to the elongated member 1101 when force is applied to the elongated member 1101 thereby cinching the tool support 1150 to an edge of the elongated member 1101.

Figure 12:
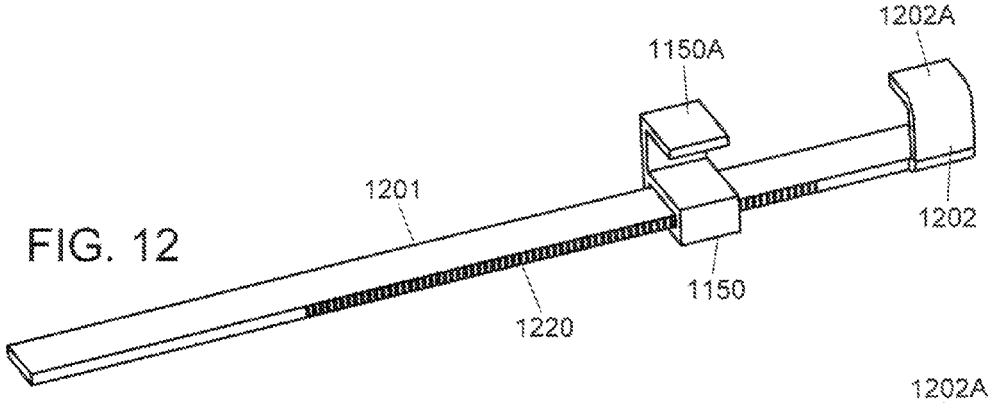
FIG. 12 is an illustration of another exemplary embodiment according to the instant invention.

FIG. 12 illustrates a similar exemplary embodiment to FIG. 11A wherein elongated member 1201 may have grooves 1220 along a transverse direction of an edge to provide for a more positive cinching of the tool support 1150.

Figure 13:
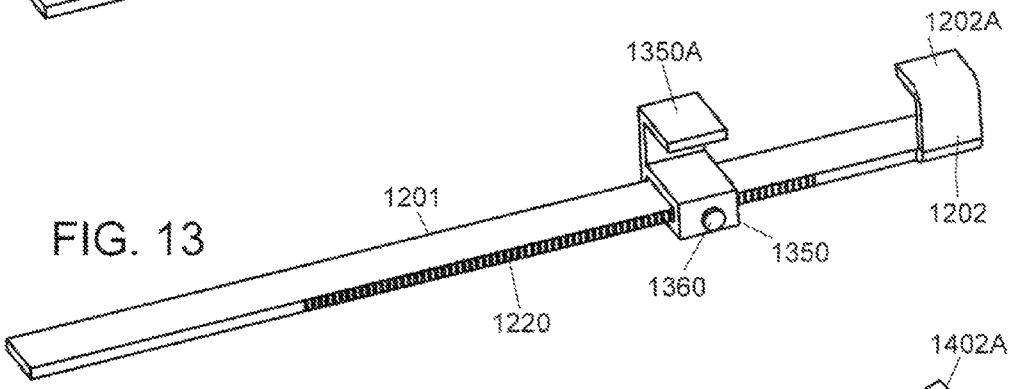
FIG. 13 is an illustration of the exemplary embodiment of FIG. 12 with a different movable tool support.

FIG. 13 shows a similar exemplary embodiment to FIG. 12, wherein a movable tool support 1350 may include a spring loaded pin 1360 for positively securing movable tool support 1350 at a desired location along elongated member 1201 by engaging the pin 1360 into a grove 1220 along elongated member 1201.

Figure 14:
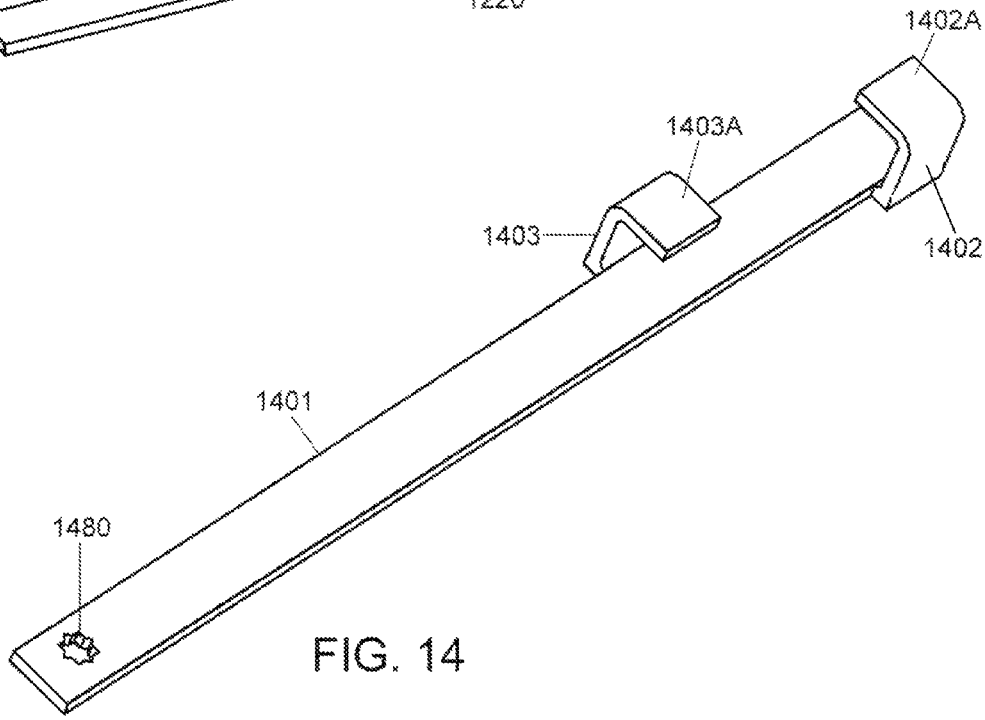
FIG. 14 is an illustration of an exemplary double-square octagram (star of Lakshmi) hole as may be used with the instant invention.

FIG. 14 shows an exemplary embodiment wherein an opening 1480 may be provided. The opening 1480 may be used for hanging the apparatus for storage, and, as illustrated herein, may be a socket drive hole in the shape of a double square octagram, or otherwise known as a Star of Lakshmi 1480 which provides for positioning a socket drive at 45 degree intervals. Each square of the double square 1480 may be sized to fit a socket drive (not shown). This may, for example, permit attachment of a breaker bar (not shown) which may provide for a greater moment of an applied force for loosening, tightening, bending or breaking an object. In certain cases access to a fastener may be limited or restricted so it may be advantageous to provide a socket drive hole such that a breaker bar may be positioned at 45 degree intervals.

Figure 15:
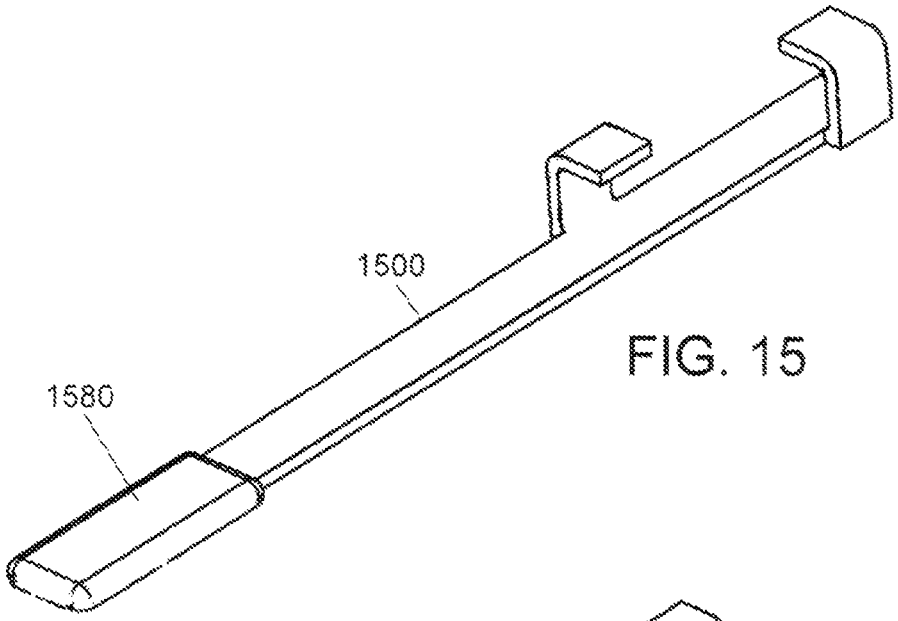
FIG. 15 is an illustration of an exemplary handle as may be used with the instant invention.

A handle 1580 may be provided as shown at FIG. 15, to provide more comfort for users when applying force. The handle 1580 may be made from any resilient cushioning material such as leather, rubber, plastic, foam, or any other material that would provide comfort to users and longevity of wear. The handle 1580 may be removable or fixed.

Figure 16:
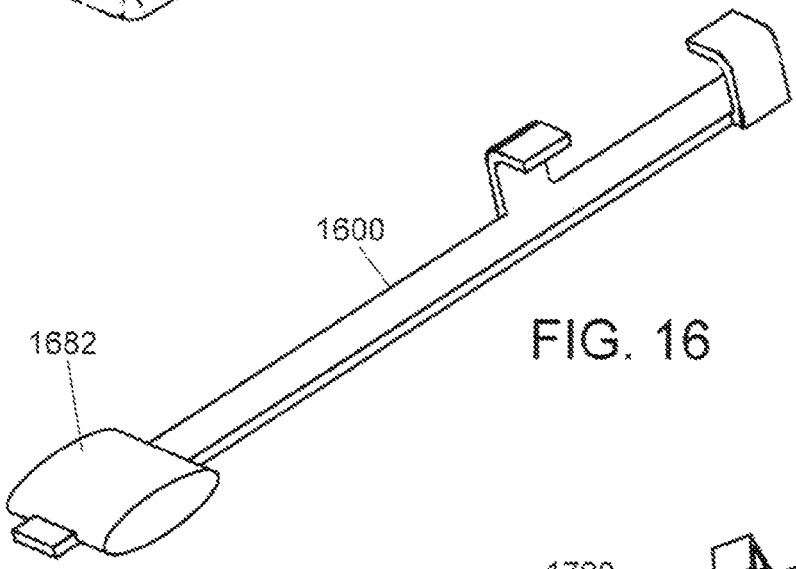
FIG. 16 is an illustration of an exemplary anvil as may be used with the instant invention.

FIG. 16 shows anvil 1682 which may provide for striking. In certain cases a strong impact may be required to loosen a fastener. This may be accomplished by striking the anvil 1682 with a mallet or hammer (not shown) and transferring the impact to an attached tool and finally to a fastener. The anvil 1682 has the advantage of protecting the apparatus 1600 from direct blows from a mallet or hammer which may mushroom an edge of the apparatus 1600 or otherwise damage the apparatus 1600.

Figure 17:
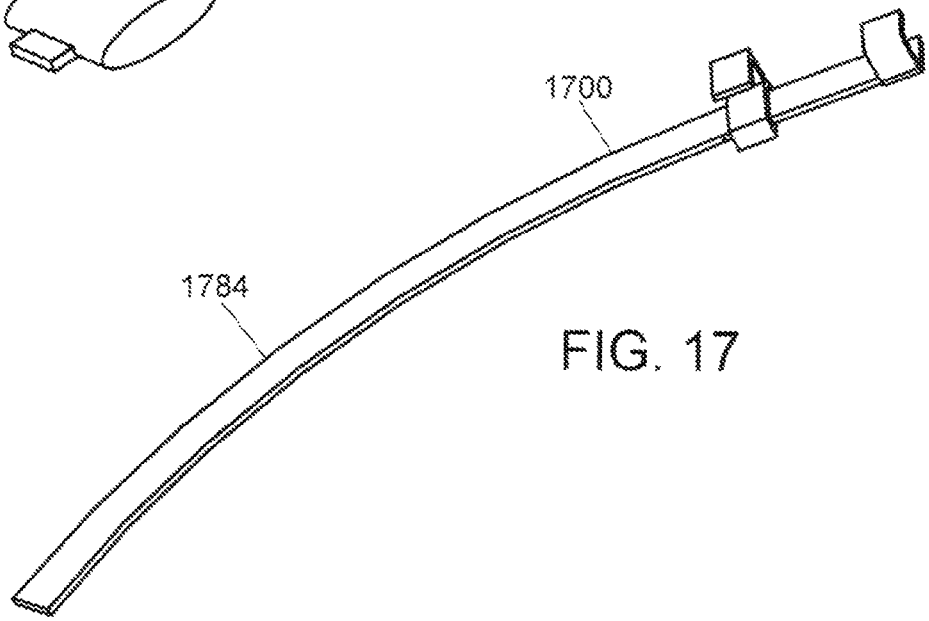
FIG. 17 is an illustration of an exemplary curved member as may be used with the instant invention.

FIG. 17 shows an embodiment where the elongated member 301 is curved for providing knuckle-room in certain situations.

Figure 18:
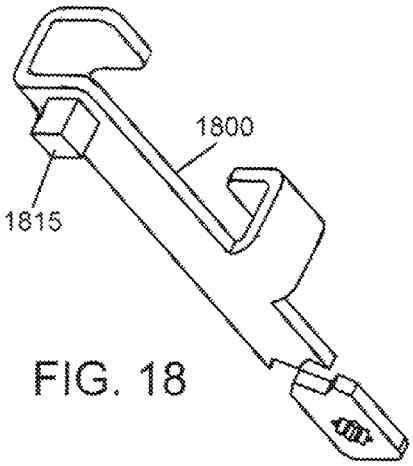
FIG. 18 is an illustration of an exemplary socket drive which may be used with the instant invention.

FIG. 18 shows another modification which includes providing a socket drive 1815 at an end of apparatus 1800. A socket drive 1815 increases the functionality of apparatus 1800 for permitting attachment of sockets (not shown).

Figure 19:
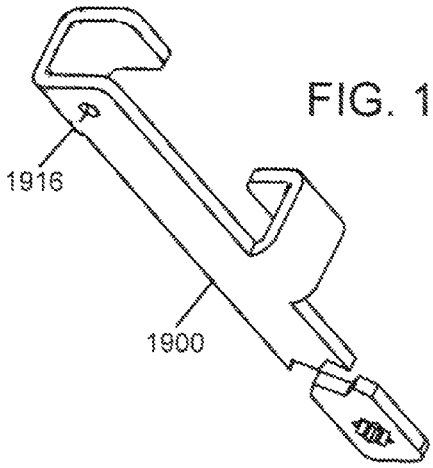
FIG. 19 is an illustration of an exemplary hole or imprint for bit insertion which may be used with the instant invention.

FIG. 19 shows a hexagonal hole 1916 at an end of apparatus 1900. The hexagonal hole 1916 may be sized to accept drive bits such as torx drive bits, Phillips and other bits (not shown). This would extend the use of the apparatus 1900 to provide an increased moment of an applied force to be used for fasteners such as screws.

Figure 20:
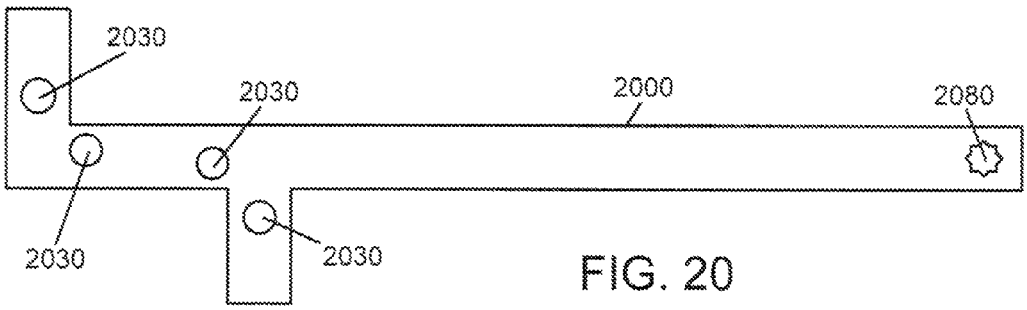
FIG. 20 is an illustration of an exemplary stamped shape which may be used for manufacturing the instant invention.

FIG. 20 illustrates one method of manufacturing the instant invention. A shape 2000 may be stamped or cut out of steel or tool steel. Holes 2030, 2080 and other shapes may be punched out, pressed or bored for accepting magnets, fasteners and other features as described herein and for providing a Star of Lakshmi 2080 shaped socket drive hole. The tabs on either side of the elongated member may be bent over to provide for tool supports. The resulting shape may be tool hardened with a heating process thereby forming an apparatus according to an embodiment of the instant invention in a fast and economical way.

Figure 21:
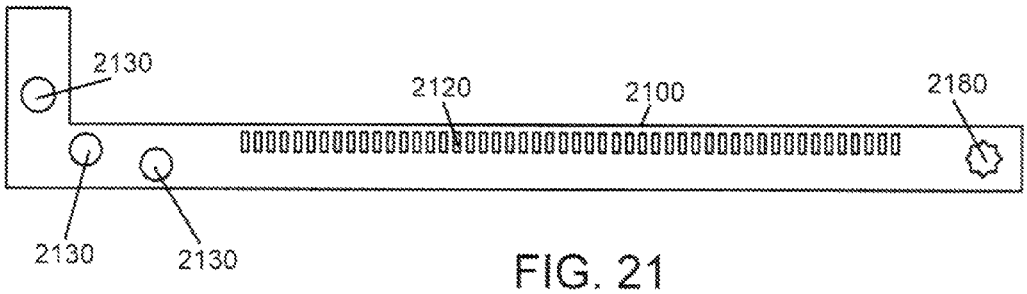
FIG. 21 is an illustration of another exemplary stamped shape which may be used for manufacturing the instant invention.

FIG. 21 illustrates another method of manufacturing the instant invention. A shape 2100 may be stamped or cut out of steel or tool steel. Holes 2130, 2180, grooves 2120, and other shapes may be punched out, pressed or bored for accepting magnets, fasteners and other features as described herein and for providing a Star of Lakshmi 2180 shaped socket drive hole. The tabs on either side of the elongated member may be bent over to provide for tool supports. The resulting shape may be tool hardened with a heating process thereby forming an apparatus according to an embodiment of the instant invention in a fast and economical way.

Figure 22:
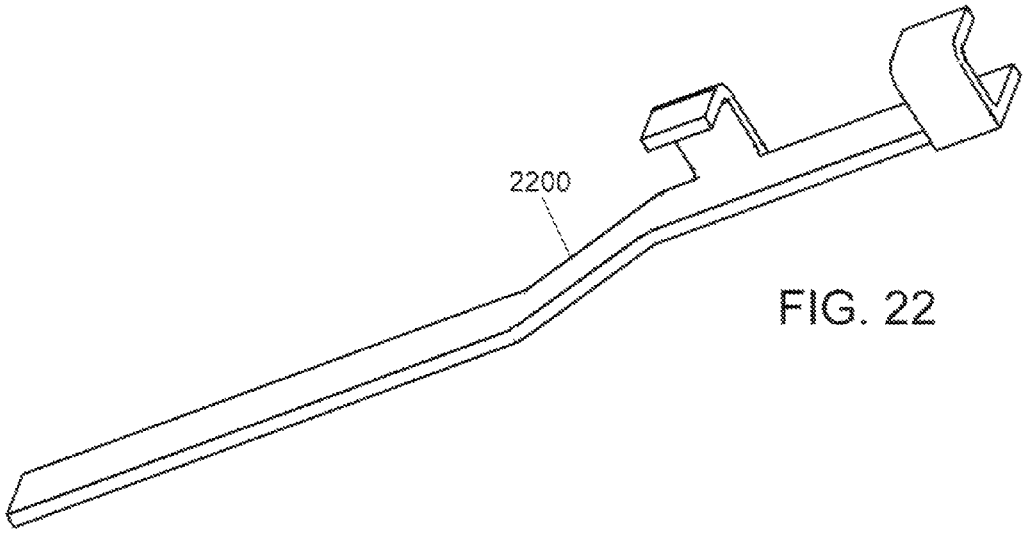
FIG. 22 is an illustration of an exemplary bend member which may be used with the instant invention.

FIG. 22 shows an exemplary embodiment where the elongated member 2200 is bent for providing knuckle-room in certain situations.

Figure 23:
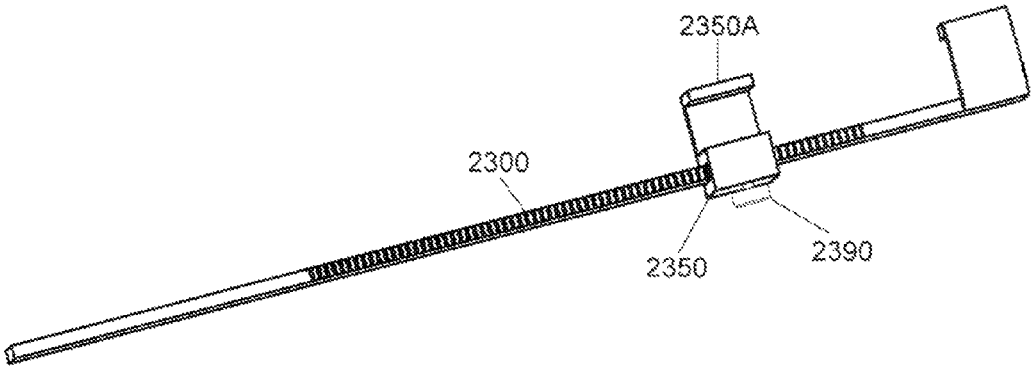
FIG. 23 is an illustration of another exemplary embodiment with rack and pinion for moving a movable tool support.

FIG. 23 illustrates an exemplary embodiment with movable tool support 2350 having a knob 2390 for turning a pinion gear (not shown) which engages rack 2300 of an elongated member. By turning the knob 2390, the movable tool support 2350 may be positioned with greater accuracy.

It will be understood that the embodiments, advantages and features which have been described and illustrated herein are to be regarded as examples and not limiting. It will be further appreciated by those of ordinary skill in the art that various changes and modifications may be made without departing from the spirit and scope of the present invention as set forth in the claims which follow.

SEQUENCE LISTING

Not applicable

I claim:

1. An apparatus for increasing a moment of a force comprising:

an elongated member having at least a first tool support and a second tool support;

said first tool support being attached to a side of the elongated member at a first position, the first position being near an end of the elongated member;

said second tool support being attached to an opposite side of the elongated member at a second position, the second position being displaced from said first position along a linear length of said elongated member such that a range of tools fit workably between the two tool supports;

wherein a top portion of at least one of the first and second tool supports comprises an angled portion;

the angled portion, the tool support and a portion of a top surface of the elongated member forming a tool seat such that a tool is prevented from rotating out from the tool support when force is applied;

wherein an underside of the angled portion of at least one of the first and second tool supports has attached thereto a resilient frictional material.

2. The apparatus according to claim 1, wherein at least one magnet is provided for holding a tool.

3. An apparatus for increasing a moment of a force comprising:

an elongated member having at least a first tool support and a second tool support;

said first tool support being attached to a side of the elongated member at a first position, the first position being near an end of the elongated member;

said second tool support being attached to an opposite side of the elongated member at a second position, the second position being displaced from said first position along a linear length of said elongated member such that a range of tools fit workably between the two tool supports;

wherein a top portion of at least one of the first and second tool supports comprises an angled portion;

the angled portion, the tool support and a portion of a top surface of the elongated member forming a tool seat such that a tool is prevented from rotating out from the tool support when force is applied;

wherein at least one of the first and second tool supports includes a spring material for clutching a tool.

4. The apparatus according to claim 3, wherein at least one magnet is provided for holding a tool.

5. An apparatus for increasing a moment of a force comprising:

an elongated member having at least a first tool support and a second tool support;

said first tool support being attached to a side of the elongated member at a first position, the first position being near an end of the elongated member;

said second tool support being attached to an opposite side of the elongated member at a second position, the second position being displaced from said first position along a linear length of said elongated member such that a range of tools fit workably between the two tool supports;

wherein a top portion of at least one of the first and second tool supports comprises an angled portion;

the angled portion, the tool support and a portion of a top surface of the elongated member forming a tool seat such that a tool is prevented from rotating out from the tool support when force is applied;

wherein the elongated member includes hook and loop material disposed between the first and second tool supports.

6. The apparatus according to claim 5, wherein at least one magnet is provided for holding a tool.

7. An apparatus for increasing a moment of a force comprising:

an elongated member having at least a first tool support and a second tool support;

said first tool support being attached to a side of the elongated member at a first position, the first position being near an end of the elongated member;

said second tool support being attached to an opposite side of the elongated member at a second position, the second position being displaced from said first position along a linear length of said elongated member such that a range of tools fit workably between the two tool supports;

wherein a top portion of at least one of the first and second tool supports comprises an angled portion;

the angled portion, the tool support and a portion of a top surface of the elongated member forming a tool seat such that a tool is prevented from rotating out from the tool support when force is applied;

wherein at least a portion of the elongated bar comprises an anvil.

8. The apparatus according to claim 7, wherein at least one magnet is provided for holding a tool.

9. An apparatus for increasing a moment of a force comprising:

an elongated member having at least a first tool support and a second tool support;

said first tool support being attached to a side of the elongated member at a first position, the first position being near an end of the elongated member;

said second tool support being movable along at least a part of a linear length of the elongated member and displaceable to positions such that a range of tools fit workably between the two tool supports;

wherein a top portion of at least one of the first and second tool supports comprises an angled portion;

said angled portion, the tool support and a portion of a top surface of the elongated member forming a tool seat such that a tool is prevented from rotating out from the tool support when force is applied;

wherein an underside of the angled portion of at least one of the first and second tool supports has attached thereto a resilient frictional material.

10. The apparatus according to claim 9, wherein at least one magnet is provided for holding a tool.

11. An apparatus for increasing a moment of a force comprising:

an elongated member having at least a first tool support and a second tool support;

said first tool support being attached to a side of the elongated member at a first position, the first position being near an end of the elongated member;

said second tool support being movable along at least a part of a linear length of the elongated member and displaceable to positions such that a range of tools fit workably between the two tool supports;

wherein a top portion of at least one of the first and second tool supports comprises an angled portion;

said angled portion, the tool support and a portion of a top surface of the elongated member forming a tool seat such that a tool is prevented from rotating out from the tool support when force is applied;

wherein at least one of the first and second tool supports includes a spring material for clutching a tool.

12. The apparatus according to claim 11, wherein at least one magnet is provided for holding a tool.

13. An apparatus for increasing a moment of a force comprising:

an elongated member having at least a first tool support and a second tool support;

said first tool support being attached to a side of the elongated member at a first position, the first position being near an end of the elongated member;

said second tool support being movable along at least a part of a linear length of the elongated member and displaceable to positions such that a range of tools fit workably between the two tool supports;

wherein a top portion of at least one of the first and second tool supports comprises an angled portion;

said angled portion, the tool support and a portion of a top surface of the elongated member forming a tool seat such that a tool is prevented from rotating out from the tool support when force is applied;

wherein the elongated member includes hook and loop material disposed between the first and second tool supports.

14. The apparatus according to claim 13, wherein at least one magnet is provided for holding a tool.

15. An apparatus for increasing a moment of a force comprising:

an elongated member having at least a first tool support and a second tool support;

said first tool support being attached to a side of the elongated member at a first position, the first position being near an end of the elongated member;

said second tool support being movable along at least a part of a linear length of the elongated member and displaceable to positions such that a range of tools fit workably between the two tool supports;

wherein a top portion of at least one of the first and second tool supports comprises an angled portion;

said angled portion, the tool support and a portion of a top surface of the elongated member forming a tool seat such that a tool is prevented from rotating out from the tool support when force is applied;

wherein at least a portion of the elongated bar comprises an anvil.

16. The apparatus according to claim 15, wherein at least one magnet is provided for holding a tool.

* * * * *